United States Patent [19]

Yamakawa et al.

[11] Patent Number: 4,714,361

[45] Date of Patent: Dec. 22, 1987

[54] STEPPER MOTOR HOMING METHOD AND SYSTEM

[75] Inventors: Kiyoshi Yamakawa, Komaki; Satoshi Yoshimoto, Gifu, both of Japan

[73] Assignee: Brother Kogyo Kabushiki Kaisha, Aichi, Japan

[21] Appl. No.: 23,792

[22] Filed: Mar. 9, 1987

[30] Foreign Application Priority Data

Mar. 11, 1986 [JP] Japan ..... 61-53090

[51] Int. Cl.[4] ..... B41J 1/30; B41J 7/96

[52] U.S. Cl. ..... 400/144.2; 318/696; 400/322; 400/154.5

[58] Field of Search ..... 400/144.2, 144.3, 154.5, 400/320, 322, 323, 902, 903, 163; 318/696

[56] References Cited

U.S. PATENT DOCUMENTS

| | | | |
|---|---|---|---|
| 4,024,447 | 3/1977 | Epstein | 400/903 X |
| 4,264,220 | 4/1981 | Okcuoglu | 400/144.2 |
| 4,279,523 | 7/1981 | Ringle | 400/322 X |
| 4,362,980 | 12/1982 | Itzkowitz | 318/685 |
| 4,504,158 | 3/1985 | Ciampi | 400/322 X |
| 4,605,324 | 8/1986 | Musso | 400/144.2 |
| 4,622,505 | 11/1986 | Okabayashi | 318/696 |
| 4,669,900 | 6/1987 | Miyake | 400/322 |

*Primary Examiner*—Paul T. Sewell

*Attorney, Agent, or Firm*—Parkhurst & Oliff

[57] ABSTRACT

A method or system for bringing a movable element of a stepper motor to its home position by mechanically blocking the movable element from further moving from the home position, wherein the movable element is moved in one direction by repeating an energization cycle in which windings for sequentially establishing different energization phases are energized in a predetermined sequence at a predetermined interval from one phase to another. After the movable element is mechanically blocked, a motor driver circuit energizes at least one of the windings which corresponds to at least one of the energization phases that precedes another of the energization phases which corresponds to the home position of the movable element. This energization of the winding or windings for each preceding phase continues for a time longer than the predetermined energization interval of the normal energization cycle. Then, the phase corresponding to the home position of the movable element is maintained to hold the motor stopped at the predetermined home position.

12 Claims, 9 Drawing Figures

STEPPER MOTOR HOMING METHOD AND SYSTEM

BACKGROUND OF THE INVENTION

1. Field of the Invention

The present invention relates generally to a technique for bringing a stepping motor to a predetermined home position, and more particularly to such a technique wherein a precise homing control of the stepper motor is effected after a movable element of the motor such as a rotor or a linearly sliding member is mechanically blocked at the home position.

2. Discussion of the Prior Art

U.S. Pat. No. 4,264,220 discloses an apparatus for homing a print wheel of a typewriter, wherein the print wheel is brought to its predetermined home position by mechanically blocking the print wheel at the home position, such that a first stop member provided on a member for rotating the print wheel comes into engagement with a fixed second stop member. According to the disclosed arrangement, the stepper motor is held in an energization phase corresponding to the home position, after the print wheel is mechanically blocked by the second stop member. Thus, the stepper motor is maintained at its home position. Thus, arrangement eliminates a detector for sensing the home position of the print wheel, and contributes to lowering the cost of the typewriter.

The homing method proposed in the above-identified U.S. Patent is widely applicable to a variety of devices or systems wherein a movable member driven by a stepper motor need to be zeroed or placed in its home position. The method is applicable not only to a rotary stepper motor, but also to a linear stepper motor.

Practically, however, the stepper motor cannot be precisely stopped at the predetermined home position simply by mechanically blocking the movable member. The motor can be brought exactly to the home position if it is possible to hold the energization phase corresponding to the home position of the motor, exactly at the moment when the movable element of the motor has been mechanically stopped by engagement of the first and second stop members. In reality, it is difficult to control the timing of energization of the windings in precise synchronization of the mechanical blocking of the print wheel. Usually, the energization phases are changed from one to another for a given time after the movable element has been mechanically stopped. Thus, the stepper motor may fail to be stopped at the predetermined home position.

For example, a rotary stepper motor is operated in a simultaneous two phase energizing mode wherein different combinations of four windings A, B, C and D are energized in a predetermined sequence so as to sequentially establish phases A-B, B-C, C-D and D-A, as indicated in FIG. 9. Suppose the phase C-D of the motor corresponds to the home position of the motor at which the rotor of the motor is mechanically stopped during rotation in the forward direction, the rotor may remain in the home phase or phase C-D position during the next energization of the windings D and A to establish the phase D-A. Alternatively, the rotor may be rotated toward the phase D-A position during the phase D-A energization, even after the rotor is mechanically blocked around the phase C-D position, since there exists a cushioning action of the second stop member upon abutting contact of the first stop member with the second stop member. The cushioning action permits the rotor to be further rotated by a slight angle in the forward direction, and thus allows the rotor to be moved toward the phase D-A position. However, in the next energization of the windings A and B so as to establish the phase A-B, the rotor teeth can not be moved further in the forward direction, and tend to be rotated in the reverse direction as indicated in FIG. 9, while being attracted by the wrong stator teeth of the same phase A-B neighbouring the true phase A-B stator teeth to which the rotor teeth should be attracted in that energization step. Subsequently, the rotor is rotated again in the forward direction as the phases B-C and C-D are established. The above events are repeated, and thus the rotor undergoes oscillating movements to and from the home phase position (phase C-D position) over a given angular range while the energization cycle is repeated, as indicated in solid line in the figure. During such oscillating movements of the rotor, the rotor may jump to the wrong phase C-D position which neighbours the true phase C-D position corresponding to the home position of the rotor, as indicated in broken line in the figure. In this instance, the rotor is erronesouly stopped at the wrong phase C-D position indicated in the broken line. Similar drawbacks are encountered also in a linear stepper motor. In the linear stepper motor, the movable element is a linearly moving member corresponding to the rotor of the rotary stepper motor.

SUMMARY OF THE INVENTION

It is accordingly an object of the present invention to provide a method by which it is possible to bring the movable element of a stepper motor exactly to its predetermined home position after the movable element is mechanically stopped.

Another object of the invention is to provide an apparatus using a stepper motor, wherein the movable element of the motor is brought exactly to its predetermined home position after the movable element is mechanically stopped.

It is a further object of the present invention to provide a printer having a print wheel which is operated by a rotary stepper motor, wherein the print wheel is brought exactly to its predetermined home position after the rotor of the motor or the print wheel is mechanically stopped.

According to the present invention, there is provided a method of bringing the movable element of the stepper motor to a predetermined home position, the method comprising the steps of: moving the movable member in one direction by repeating an energization cycle wherein windings for sequentially establishing a plurality of energization phases of the motor are energized in a predetermined sequence at a predetermined energization interval from one energization phase to another; mechanically blocking the movable element from further moving from the home position in the above one direction; after mechanically blocking the movable element, energizing at least one of the windings which corresponds to at least one of the energization phases that precedes, in the above-indicated predetermined sequence, another of the energization phases which corresponds to the predetermined home position of the movable element, the above-indicated at least one of the windings being energized for a time span longer than the predetermined energization interval of the energization cycle, for each of the at least one energization phase preceding the another energization phase; and maintaining the above-indicated another energization phase corresponding to the home position of the movable element, and thereby holding the movable element at the predetermined home position.

According to the above method of the invention, the movable element of the stepper motor can be stopped exactly at the predetermined home position, without fail.

For instance, when the winding or windings are energized for the above-indicated relatively long time span so as to establish the energization phase corresponding to the home position of the movable element, the movable element oscillates in an initial portion of the energization time span, and is eventually stopped at the predetermined home position, or alternatively at a position of the wrong stator teeth of the same energization phase which neighbours in the reverse direction the true stator teeth corresponding to the home position. Even in the latter case, the movable element can be brought to the home position, upon completion of at least one energization cycle which takes place after the mechanical blocking of the movable element. In this condition, the phase corresponding to the home position is held energized, whereby the movable element is held in the home position. In the former case wherein the movable element is located at its home position at the end of the first long energization, the movable element is once stepped away from the home position in the reverse direction due to the second or subsequent energization. However, the movable element is finally brought to the home position by the following stepping movement or movements in the forward direction due to the subsequent energization step or steps.

Thus, the movable element can be always brought to the predetermined home position, under any conditions, by energizing the windings corresponding to at least one energization cycle so as to sequentially establish the different phases one afte another at the relatively long energization interval after the movable element is mechanically blocked. However, if the amplitude of the oscillating movement of the movable element following the mechanical blocking is short, and the movable element tends to be moved to the phase position just before the phase position corresponding to the home position, the movable element can be brought to the home position by energizing only the winding or winding corresponding to that preceding phase, for the relatively long time span, after the movable element is mechanically blocked, and before the winding or windings corresponding to the home position are energized. In this case, the home position of the movable element is established by only one stepping movement of the movable element which results from the single operation to energize the appropriate winding or windings for the time span longer than that of the normal energization cycle.

The amplitude of the oscillating movement of the movable element which occurs following the mechanical blocking is determined by the moment of inertia and other parameters of a device or component which is driven by the stepping motor. Hence, the required minimum number of steps of energization each for the relatively long time span is determined by the specific device or component driven by the stepper motor.

According to the instant method, the movable element of the stepper motor can be stopped precisely at the predetermined home position, without using a detector for detecting the home position of the movable element or a home position of a member driven by the stepper motor. Further, the method according to the invention eliminates a conventionally experienced inaccurate homing of the movable element which arises from erroneous electromagnetic attraction of the movable element, for example, by a pair of energized stator pole pieces which are located adjacent to the stator pole pieces assigned to establish the phase corresponding to the home position of the movable element.

The above advantages can be offered without substantially increasing the cost of the apparatus incorporating the stepper motor, since the homing of the movable element of the motor simply requires energizing at least one of the windings of the motor for the phase that precedes the phase corresponding to the home position of the movable element, after the movable element has been mechanically blocked.

According to another aspect of the present invention, there is provided an apparatus which comprises: (a) a stepping motor including windings for sequentially establishing a plurality of energization phases, and a movable element which is movable in opposite directions; (b) a motor driver circuit connected to the windings, for moving the movable element in one of the opposite directions, by repeating an energization cycle in which the windings are energized in a predetermined sequence at a predetermined energization interval from one energization phase to another; (c) a mechanical blocking means for mechanically blocking the movable element from further moving away from a predetermined home position in the above-indicated one direction; and (d) homing control means operable after the movable element has been mechanically blocked by the mechanical blocking means, for activating the motor driver circuit to energize at least one of the windings which corresponds to at least one of the energization phases that precedes, in the predetermined sequence, another of the energization phases which corresponds to the predetermined home position of the movable element. The above-indicated at least one of the windings is energized for a time span longer than the predetermined energization interval of the energization cycle, for each of the at least one energization phase preceding the above-indicated another energization phase. The homing control means then activates the motor driver circuit to maintain the above another energization phase, and thereby hold the movable element at the predetermined home position.

According to one advantageous feature of the above aspect of the invention, the homing control means activates the motor drive circuit to energize the windings in the predetermined sequence, in order to perform at least one energization cycle of the motor.

In accordance with a further aspect of the invention, there is provided a printer for printing on a recording medium, comprising: (a) support means for supporting the recording medium; (b) a print wheel rotatable about an axis thereof, and having a multiplicity of radial arms which bear at free ends thereof respective typing elements; (c) a rotary stepping motor including a rotor rotatable in opposite directions and operatively connected to the print wheel, and windings for sequentially establishing a plurality of energization phases; (d) a motor driver circuit connected to the windings, for repeatedly performing an energization cycle in which the windings are energized in a predetermined sequence at a predetermined energization interval from one energization phase to another, whereby the rotor is rotated to bring selected one of the typing elements into a printing position; (e) a hammer operable to impact the selected one typing element in the printing position against the recording medium supported by the support means; (f) a mechanical blocking means for mechanically blocking the print wheel from further rotating from a predetermined home position in one of the opposite directions; and (g) homing control means operable after the movable element has been mechanically blocked by the mechanical blocking means, for activating the motor driver circuit to energize at least one of the windings which corresponds to at least one of the energization phases that precedes, in the predetermined sequence, another of the energization phases which corresponds to the predetermined home position of the movable element. The above-indicated at least one of the windings is energized for a time span longer than the predetermined energization interval of the energization cycle, for each of the above at least one energization phase preceding the another energization phase. The homing control means then causes the motor driver circuit to maintain the above-indicated another energization phase, and thereby hold the rotor at the predetermined home position.

According to one advantageous feature of the above aspect of the invention, the time span for which the above-indicated at least one winding is energized for each of the at least oen energization phase is longer than a time duration necessary for substantially settling a rotary oscillating movement of the print wheel during a mechanical blocking of the print wheel by the mechanical blocking means.

According to another advantageous feature of the same aspect of the invention, the printer further comprises a carriage carrying thereon the stepping motor and the print wheel, and movable in a direction parallel to the recording medium supported by the support means, and further comprises a wheel holder connected to the rotor of the stepping motor rotatably about an axis thereof, and holding the print wheel. In this case, the mechanical blocking means includes: a detent arm attached to the carriage pivotally about an axis parallel to the axis of rotation of the wheel holder, the detent arm having a first stop member; a second stop member provided on the wheel holder, such that the second stop member is engageable with the first stop member during rotation of the wheel holder, for mechanically blocking the wheel holder, and thereby blocking the print wheel from further rotating away from the predetermined home position; and an arm actuator for pivotally moving the detent arm between an operative position in which the first stop member is engageable with the second stop member, and an inoperative position wherein the first stop member is out of a path of the second stop member.

In one form of the above feature of the invention, the arm actuator comprises biasing means for biasing the detent arm toward the inoperative position, and a stationary actuator member which is engageable with the detent arm, to pivot the detent arm to the operative position against the biasing action of the biasing means, when the carriage is moved to a predetermined position.

In another form of the same feature of the invention, the detent arm is provided with a resilient member fixed thereto. The resilient member is adapted to be elastically deformable to permit the carriage to move to the predetermined position, even if the wheel holder is positioned such that the second stop member abuts on the first stop member during a pivotal movement of the detent arm toward the operative position.

BRIEF DESCRIPTION OF THE DRAWINGS

The above and other objects, features and advantages of the present invention will be better understood by reading the following detailed description of preferred embodiments of the invention, when considered in connection with the accompanying drawings, in which.

DETAILED DESCRIPTION OF THE PREFERRED EMBODIMENTS

Figure 1:
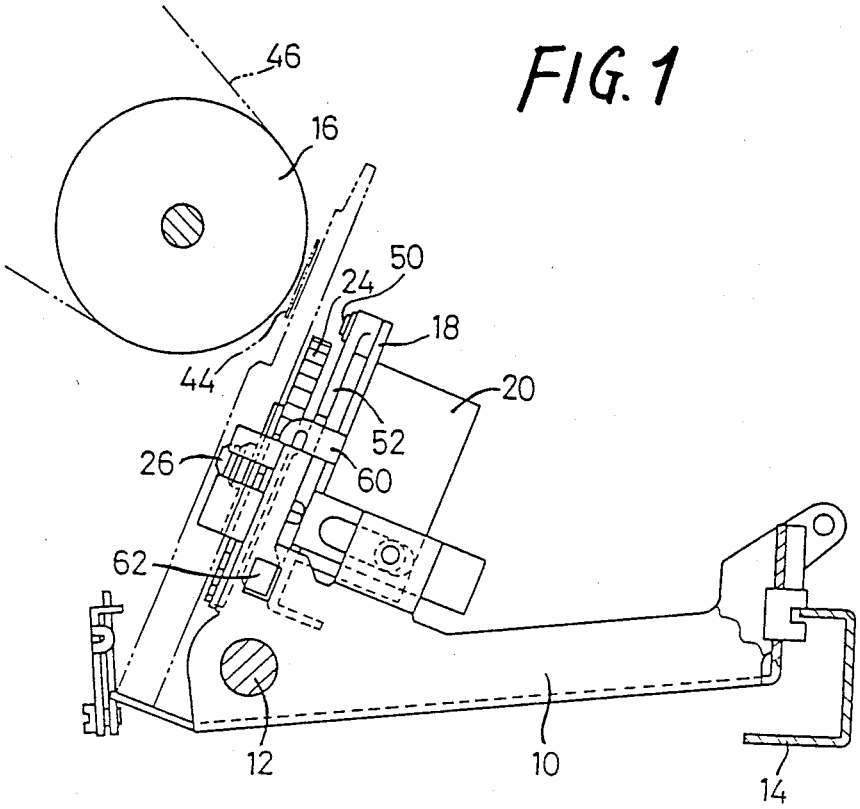
FIG. 1 is a fragmentary side elevational view in cross section of a printing mechanism of one embodiment of a printer of the present invention, in the form of a typewriter having a stepping motor which is brought to its home position according to the invention.
Figure 2:
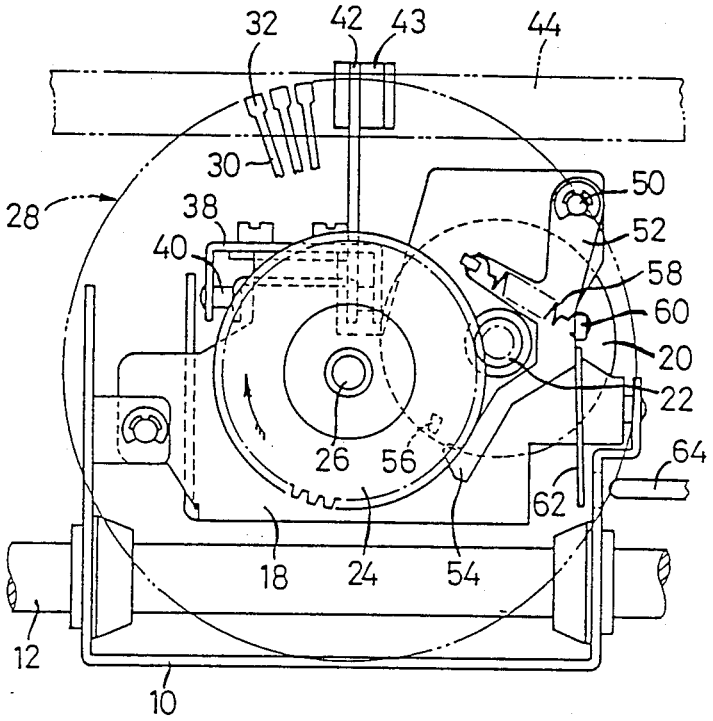
FIG. 2 is a front elevationary view of the printing mechanism shown in FIG. 1.

Referring first to FIGS. 1 and 2, there is shown a printing mechanism of a typewriter to which the principle of the present invention is applied to establish a home position of a rotary stepper motor 20 for operating a print wheel 28. In the figures, reference numeral 10 designates a carriage which is moved parallel to a platen 16 while being supported and guided by a guide rod 12 and a guide rail 14. The platen 16 functions as support means for supporting a recording medium in the form of a sheet of paper 46 on which printing is effected along a print line parallel to the axis of rotation of the platen.

Figure 3:
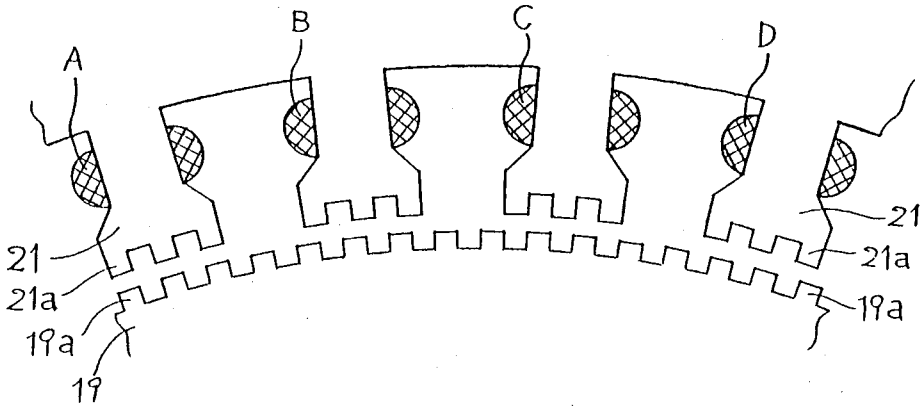
FIG. 3 is a schematic fragmentary view of the interior construction of the stepping motor.

The carriage 10 has a motor bracket 18 fixed thereto, and carries the stepper motor 20 attached thereto via the motor bracket 18. As shown in FIG. 3, the stepper motor 20 has a rotor 19 which is rotatable in opposite directions by sequential energization of stator windings A, B, C and D, as well known in the art. These windings A, B, C and D are wound on respective stator pole pieces 21 which are arranged in spaced-apart relation in the circumferential direction of the rotor 19. The stator pole pieces 21 have stator teeth **21*a* which are formed so as to face rotor teeth 19*a* formed on the rotor 19. The operation of the stepper motor 20** will be described later in detail.

The output shaft of the stepper motor 20 fixed to the rotor 19 has a pinion 22 fixed thereto, and is connected to the print wheel 28 such that the pinion 22 meshes with a gear 24 which is rotatably supported by the bracket 18 and is fixed to the print wheel 28. The gear 28 has a shaft 26 which extends through the bracket 18. The print wheel 28 is secured to the free end of the shaft 26, at a predetermined angular position relative to the shaft 26. Thus, the shaft 26 functions as a holder for rotatably supporting the print wheel 28. The print wheel 28 has a multiplicity of radial arms 30 which are spaced apart from each other in the circumferential direction. The radial arms 30 has different typing elements 32 at their free ends. In this embodiment, a total of 96 typing elements 32 are provided.

On the motor bracket 18, there is also fixed a pin 40 which pivotally supports a hammer bracket 38, which in turn supports a hammer 42 fixed thereto. The hammer 42 is pivotally operated to its operating position by a hammer solenoid 43 secured to the motor bracket 18. With the hammer 42 pivoted to its opeating position, the currently selected typing element 32 is struck or impacted at its back, against the paper 46 via a print ribbon 44. Thus, a character corresponding to the hammered typing element 32 is printed on the paper 46.

The motor bracket 18 has a shaft 50 fixed thereto, and a detent arm 52 which is pivotally supported about the axis of the shaft 50. More specifically, the detent arm 52 is pivotable in a plane parallel to the rotating plate of the gear 24, between an operative position and an inoperative position. The detent arm 54 has a first stop member in the form of a hook 54 formed integrally at its free end, while the gear 24 has a second stop member in the form of a tab 56. While the detent arm 52 is placed in its operative position, the hook 54 is engageable with the tab 56 during rotation of the gear 24. The detent arm 52 is biased by a spring 58 in a counterclockwise direction (as viewed in FIG. 2), whereby the detect arm 52 is normally placed in its inoperative position, which is determined by a stop 60.

The detent arm 52 is provided with a resilient member 62 secured thereto. The resilient member 62 comes into abutting contact with a stationary arm actuator 64, when the carriage 10 has moved in the right direction (in FIG. 2) to a predetermined reference position within a right margin area beyond a preset printing zone. As a result of this abutting contact, the detent arm 52 is pivoted in the clockwise direction to the operative position, against the biasing action of the spring 58, for engagement of the hook 54 with the tab 56 on the gear 24. Thus, the detent arm 52 having the hook 54, and the tab 56 on the gear 24, cooperate to function as means for mechanically blocking the gear 24 and therefore the print wheel 28 from further rotating in the clockwise direction (in FIG. 2) away from a predetermined home position. Further, the spring 60, resilient member 62 and stationary actuator 62 cooperate with a drive source for the carriage 10, to serve as an actuator for operating the detent arm 52 between its operative and inoperative positions.

Figure 4:
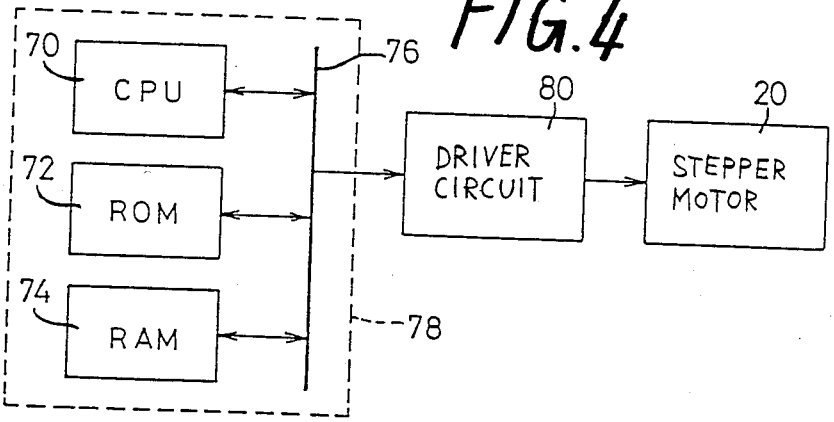
FIG. 4 is a block schematic diagram illustrating a control system for controlling the stepper motor of the typewriter.

Referring next to FIG. 4, the stepping motor 20 is driven by a motor driver circuit 80, which is controlled by a microcomputer 78 that includes a central processing unit 70 (CPU), a read-only memory 72 (ROM) and a random-access memory 74 (RAM). The ROM 72 stores various control programs for controlling the typewriter, such as a program for effecting a motor homing routine (illustrated in the flow chart of FIG. 5) for bringing the stepper motor 20 to its predetermined home position. The CPU 70 is adapted to execute these control programs, while utilizing a temporary data storage function of the RAM 74.

There will next be described the motor homing routine, by reference to the flow chart of FIG. 5.

As soon as the carriage 10 has been moved to its reference position and the detent arm 52 has been pivoted to its operative position for mechanically blocking the gear 24, the reference position of the carriage 10 is sensed by a suitable detector. A signal generated by this detector is applied to the CPU 70, and the motor homing routine of FIG. 5 will be executed as described below.

Initially, the CPU 70 executes step S1 wherein a value "98" is set in a counter. This value "98" is the number of the typing elements 32 plus "2", that is, "96" plus "2" (98=96+2). Step S1 is followed by step S2 wherein the stepper motor 20 is incremented one step to rotate the print wheel 28 one step in the forward direction (clockwise direction in FIG. 2). For easy understanding, it is assumed in this embodiment that one step of operation of the stepper motor 20 results in one indexing step of the print wheel 28 (which causes the currently selected typing element 32 to be replaced by the next one). Then, the CPU 70 goes to step S3 to start or turn on a first timer which is set to measure a time period of 3 msec. The completion of measurement of this time period in step S3 causes the CPU 70 to decrement the counter by one ("1") in step S4. The CPU 70 then goes to step S5 to check if the counter has been zeroed or not. At this point of time in the present specific example, the current count of the counter is "97", and therefore the control returns to step S2, to repeat steps S2–S5.

The above steps S2–S5 are repeated until the judgement in step S5 becomes affirmative (YES), namely, until the stepper motor 20 has been energized 98 steps which correspond to one full revolution of the print wheel 28, plus a fraction of one revolution corresponding to the two indexing increments (two typing elements 32) of the print wheel 28.

Figure 9:
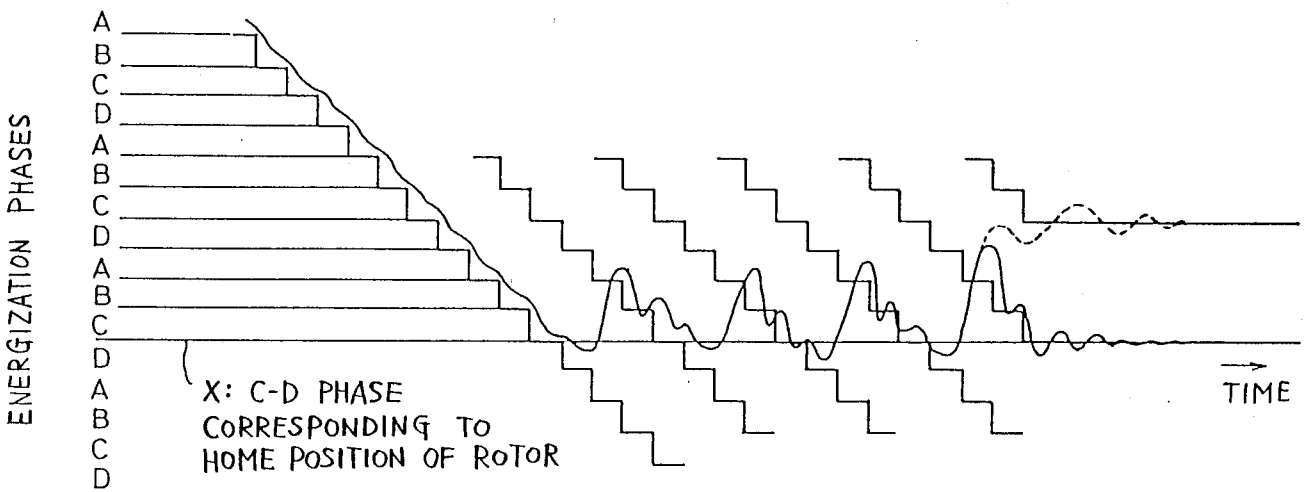
FIG. 9 PRIOR ART
FIG. 9 is a diagram also corresponding to that of FIG. 5, showing the rotor movements controlled according to a conventional arrangement.

It will be understood that the tab 56 on the gear 24 comes into engagement with the hook 54 of the detent arm 52 in the operative position, at a certain point of time during the 98 steps of energization of the windings of the stepper motor 20. Namely, irrespective of the specific angular position of the print wheel 28 when the carriage 10 has been moved to its reference position, the print wheel 28 can be mechanically blocked at the predetermined home position through engagement of the hook 54 and the tab 56, during the 98 steps of energization of the stepper motor 20. Even after the rotor 19 of the stepper motor 20 has been mechanically blocked by the mechanical blocking of the gear 24, the windings A, B, C and D of the stepper motor 20 are energized by the remaining number of steps in a predetermined sequence, with the rotor 19 repeating a small oscillating movement to and from the blocked position, as indicated in FIG. 9.

If the gear 24 is positioned such that its tab 56 abuts on the hook 54 of the detent arm 52 during a pivotal movement of the detent arm 52 toward its operative position when the carriage 10 has approached the predetermined reference position, the resilient member 62 is elastically deformed, permitting the carriage 10 to move to the predetermined reference position, even in the above case. When the gear 24 is subsequently rotated, the tab 56 disengages from the hook 54, and the detent arm 52 is pivotally moved to its operative position under the biasing action of the resilient member 62. The tab 56 comes into engagement with the hook 54 when the gear 24 has rotated a substantially one full revolution.

Figure 6:
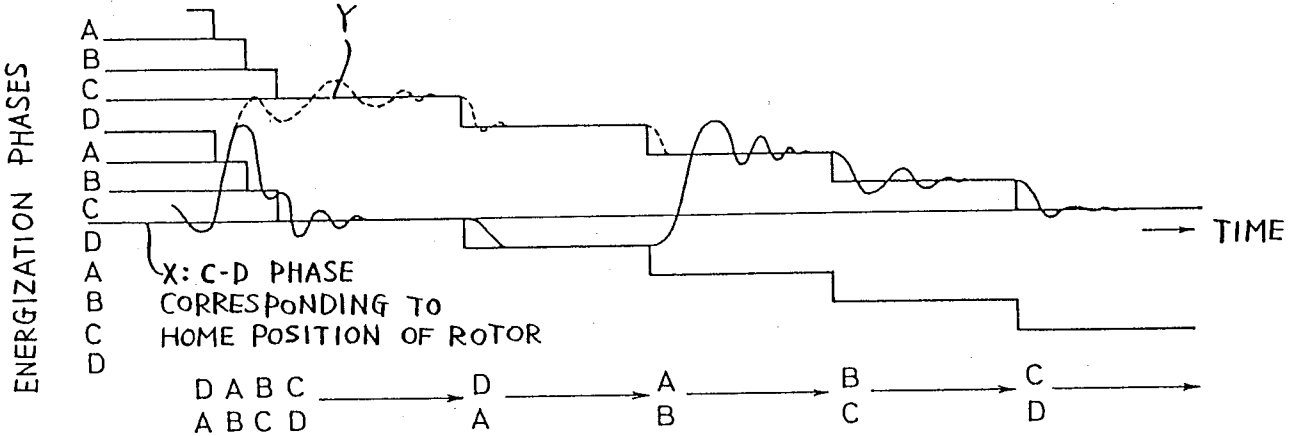
FIG. 6 is a diagram indicating movements of the rotor of the stepper motor, in relation to different energization phases.

In the present embodiment, an energization cycle is performed in a simultaneous two-phase mode. Described in more detail, the energization cycle occurs such that four different pairs of the four stator windings A, B, C and D are energized in the predetermined sequence, to establish phases A-B, B-C, C-D and D-A in this order, as indicated in FIG. 6. For example, when the windings A and B are simultaneously energized, the stepper motor 20 is placed in the phase A-B in which the rotor 19 is placed in a phase A-B position. As the winding pairs are sequentially energized, the four different phases are sequentially established, whereby the rotor 19 is rotated. In this specific example, the predetermined home position of the rotor 19 and the print wheel 28 corresponds to the phase C-D of the energization cycle.

Referring back to step S5, if the decision in the step is affirmative, that is, if the windings of the stepper motor 20 have been energized 98 steps, step S5 is followed by step S6 in which the CPU 70 checks to see if the stepper motor 20 is placed in the phase C-D. If not, step S6 is followed by step S7 wherein an additional value "1" is set in the counter previously indicated. Then, steps S3–S5 are performed to energize the stepper motor 20 one more step. These steps S7 and S2–S6 are repeated until an affirmative decision is obtained in step S6. If step S6 gives an affirmative decision, the CPU 70 then goes to step S8 wherein a value "4" is set in the counter. Step S8 is followed by step S9 to turn on a second timer. This second timer is set to measure a time period of 40 msec, in this specific example. Upon elapse of this set time of 40 msec., the stepper motor 20 is energized one step in step S10, and the counter is decremented by one "1" in step S11. Then, step S12 is executed to check if the counter has been zeroed or not. In this manner, steps S8–S12 are repeated until an affirmative decision is obtained in step S12, that is, until the stepper motor 20 has been energized by four steps. In other words, the steps S8–S12 cause the stepper motor 20 to perform one complete energization cycle (with the phases changing in the following order: C-D, D-A, A-B and B-C) after the affirmative decision has been obtained in step S6. Then, the stepper motor 20 is placed again in the phase C-D after the motor windings have been energized four steps. Step S12 is followed by step S13 in which the second timer is again started to allow 40 msecs to elapse with the phase C-D maintained, before the CPU 70 goes back to a main control routine.

While the step S9 is executed for the first time after an affirmative decision is given in step S6, the rotor teeth 19*a* of the stepper motor 20 are placed in a phase C-D position, i.e., at a position at which the rotor teeth are offset the same distances from the stator teeth 21*a*, 21*a* on the adjacent pole pieces 21 on which the windings C and D are wound (FIG. 3). In FIG. 6, the true phase C-D position corresponding to the home position of the stepper motor 20 is indicated at X, and the wrong phase C-D position neighbouring the home position is indicated at Y. While the phase C-D is maintained for 40 msec during the first execution of step S9, the rotor 19 is placed either in the true phase C-D position X, or in the wrong phase C-D position Y. In either case, the rotor 19 oscillates around the phase C-D position X or Y, with a relatively large amplitude in the initial portion of the 40 msec time span which is counted by the second timer in step S9. However, the oscillation of the rotor 19 is finally settled, and the rotor 19 is brought to the phase C-D position X or Y at the end of the 40 msec holding of the phase C-D.

In the case where the rotor 19 is placed in the wrong phase C-D position Y at the end of the 40-msec phase C-D maintenance in the first execution of step S9, the rotor 19 is then incremented in the forward direction three steps with the phases D-A, A-B and B-C being sequentially established as indicated in FIG. 6, as a result of repeated execution of steps S9–S12, which cooperates with the first C-D phase energization to constitute one energization cycle of the motor 20. Then, the rotor 19 is again brought to the true phase C-D position X, which is maintained for the 40 msec period in step S13. Namely, the rotor 19 is maintained in the true phase C-D corresponding to the home position of the motor 20. If the rotor 19 is placed in the true phase C-D position X, the rotor 19 is held in the phase C-D position X during the first execution of step S9. This phase C-D position X may or may not be maintained during the next phase D-A energization. Namely, the rotor 19 may possibly be moved to the phase D-A position following the phase C-D position, as indicated in solid line in FIG. 6, due to a slight pivotal movement of the detent arm 52 which may arise from an elastic deformation of the resilient member 62. In either instance, when the next phase A-B energization is effected, the mechanical blocking of the gear 24 does not permit the rotor 19 to be rotated to the following phase A-B position, whereby the rotor 19 will be rotated a slight angle in the reverse direction, and brought to the wrong phase A-B position as indicated in FIG. 6. Subsequently, the phase B-C and phase C-D energizations are effected to increment the rotor 19 two steps in the forward direction, whereby the rotor 19 is finally placed in the true phase C-D position X, that is, in the predetermined home position.

If the amplitudie of the rotor 19 of the stepper motor 20 after the mechanical blocking is large to such an extent that the rotor 19 jumps in the reverse direction to another wrong phase C-D position neighbouring the wrong phase C-D position Y, the rotor 19 may be restored back to the true phase C-D position X (home position) by setting the counter to "8", "12" or other multiples of "4" in step S8.

Figure 7:
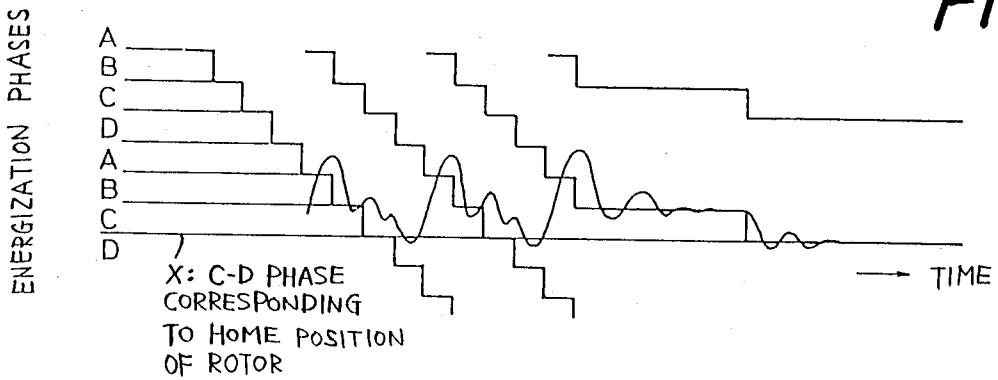
FIGS. 7 and 8 are diagrams corresponding to that of FIG. 5, depicting modified embodiments of the method of the invention.
Figure 8:
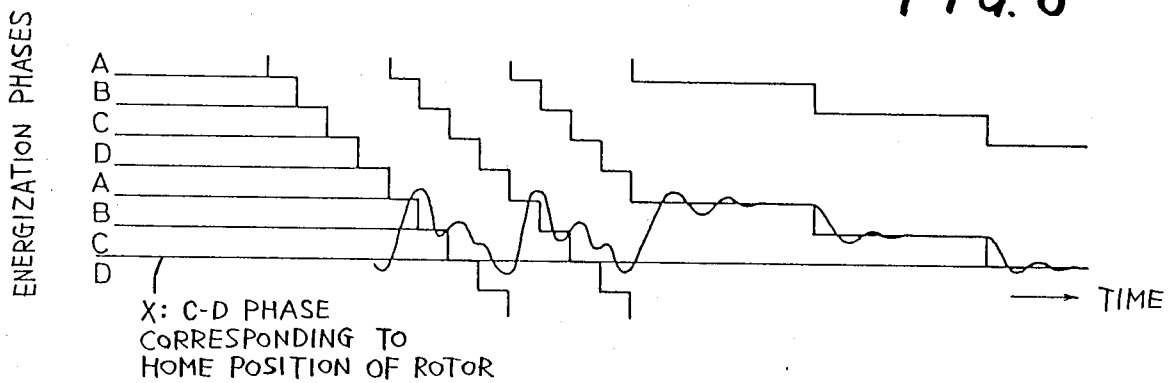

On the other hand, if the amplitude of the oscillating movement of the rotor 19 after the mechanical blocking is considerably small, and the rotor 19 has a tendency that the rotor 19 jumps to the phase B-C position just before the phase C-D position X, as indicated in solid line in FIG. 7, or to the preceding phase A-B position as indicated in FIG. 8, a value "1" or "2" is set in the counter in step S8 so that the windings of the stepper motor 20 are energized only one step (phase B-C to phase C-D) or two steps (phase A-B to phase B-C, and to phase C-D).

Although it has been assumed for the sake of easy understanding that one step energization of the stepper motor 20 results in one step indexing of the print wheel 28 to change the typing elements 32 from one to another, the one step indexing of the print wheel 28 corresponds to a plurality of energization steps of the stepper motor 20. In this case, the value to be set in the coutner in step S1 of the motor homing routine of FIG. 5 is equal to:

$$(N+a)\times n$$

where,

N: number of the typing elements 32, a: positive integer (including zero) which corresponds to a desired angle of rotation of the print wheel 20 to be added to one full revolution given by N, n: number of steps of the stepper motor that gives one indexing motion of the print wheel 28 corresponding to a spacing between the adjacent typing elements 32.

Figure 5:
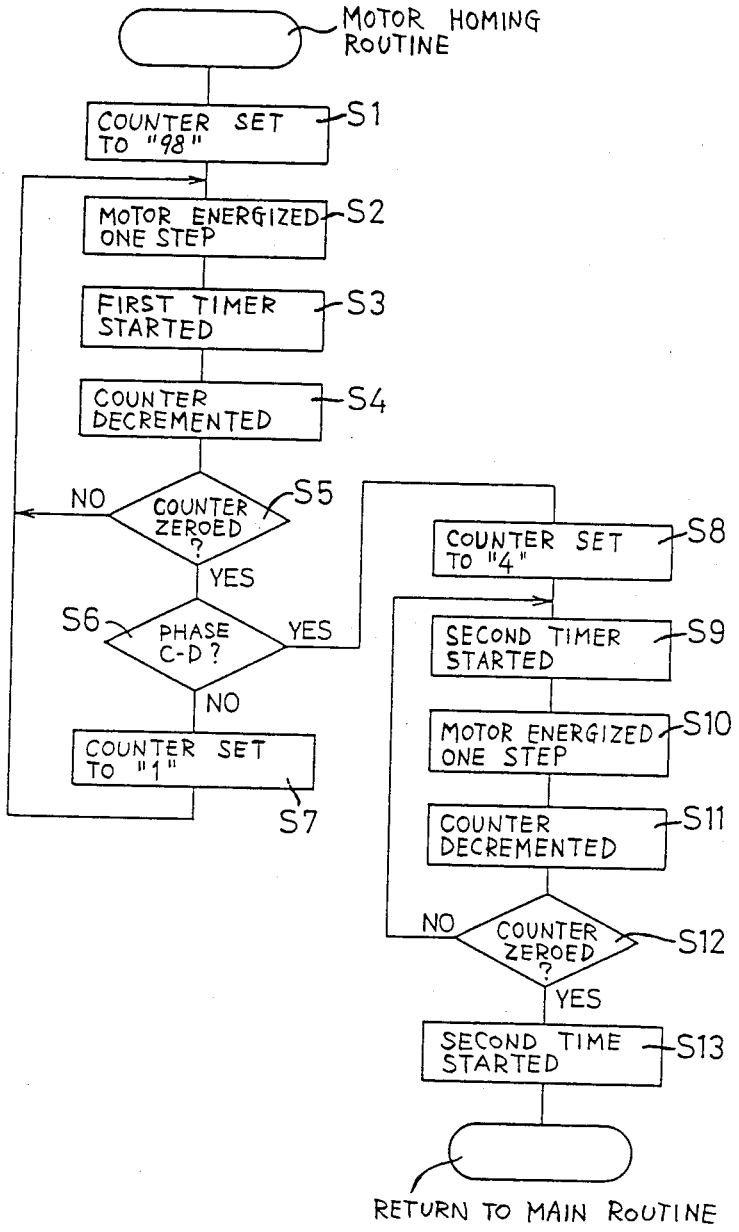
FIG. 5 is a flow chart representing an example of a control program for bringing the stepper motor to its home position, in one form of a method according to the invention.

In this case, too, the stepper motor 20 is energized one step in step S2 of FIG. 5.

Although the embodiment of FIGS. 5–6, and the modified embodiments of FIGS. 7 and 8 are adapted such that the stepper motor 20 is operated in the simultaneous two-phase energization mode, the principle of the present invention is applicable to a stepper motor which is operated in a single phase mode, or an alternate single and two phase mode. In the single phase mode, the stator windings A, B, C and D are sequentially energized. In the alternate single and two phase mode, the first energization occurs on the winding A, the second energization occuring on the windings A and B, the third energization occuring on the winding B, the fourth energization occuring on the winding B and C, and so on, for example.

While the present invention has been described in its preferred embodiments, it is to be understood that the invention is not limited thereto, but the invention may be embodied with various changes, modifications and improvements which may occur to those skilled in the art, without departing from the spirit and scope of the invention defined in the following claims.

What is claimed is:

1. A method of bringing a movable element of a stepper motor to a predetermined home position, comprising the steps of:

moving said movable member in one direction by repeating an energization cycle wherein windings for sequentially establishing a plurality of energization phases of said motor are energized in a predetermined sequence at a predetermined energization interval from one energization phase to another;

mechanically blocking said movable element from further moving from said home position in said one direction;

after mechanically blocking said movable element, energizing at least one of said windings which corresponds to at least one of said energization phases that precedes, in said predetermined sequence, another of said energization phases which corresponds to said predetermined home position of said movable element, said at least one of said windings being energized for a time span longer than said predetermined energization interval of said energization cycle, for each of said at least one energization phase preceding said another energization phase; and maintaining said another energization phase and thereby holding said movable element at said predetermined home position.

2. A method according to claim 1, wherein said step of energizing at least one of said windings comprises energizing the windings in said predetermined sequence to perform at least one energization cycle of said motor.

3. A method according to claim 1, wherein said movable element consists of a rotor rotatable about an axis thereof.

4. A method according to claim 1, wherein said movable element of said stepper motor is a sliding member which is linearly slidable.

5. A combination comprising:

a stepping motor including windings for sequentially establishing a plurality of energization phases, and a movable element which is movable in opposite directions;

a motor driver circuit connected to said windings, for moving said movable element in one of said opposite directions, by repeating an energization cycle in which said windings are energized in a predetermined sequence at a predetermined energization interval from one energization phase to another;

a mechanical blocking means for mechanically blocking said movable element from further moving from a predetermined home position in said one direction; and homing control means operable after said movable element has been mechanically blocked by said mechanical blocking means, for activating said motor driver circuit to energize at least one of said windings which corresponds to at least one of said energization phases that precedes, in said predetermined sequence, another of said energization phases which corresponds to said predetermined home position of said movable element, said at least one of said windings being energized for a time span longer than said predetermined energization interval of said energization cycle, for each of said at least one energization phase preceding said another energization phase, said homing control means then activating said motor driver circuit to maintain said another energization phase, and thereby hold said movable element at said predetermined home position.

6. A combination according to claim 5, wherein said homing control means activates said motor drive circuit to energize the windings in said predetermined sequence, in order to perform at least one energization cycle of said motor.

7. A printer for printing on a recording medium, comprising:

support means for supporting said recording medium;

a print wheel rotatable about an axis thereof, and having a multiplicity of radial arms which bear at free ends thereof respective typing elements;

a rotary stepping motor including a rotor rotatable in opposite directions and operatively connected to said print wheel, and windings for sequentially establishing a plurality of energization phases;

a motor driver circuit connected to said windings, for repeatedly performing an energization cycle in which said windings are energized in a predetermined sequence at a predetermined energization interval from one energization phase to another, whereby said rotor is rotated to bring selected one of said typing elements into a printing position;

a hammer operable to impact said selected one typing element in said printing position against said recording medium supported by said support means;

a mechanical blocking means for mechanically blocking said print wheel from further rotating from a predetermined home position in one of said opposite directions; and homing control means operable after said movable element has been mechanically blocked by said mechanical blocking means, for activating said motor driver circuit to energize at least one of said windings which corresponds to at least one of said energization phases that precedes, in said predetermined sequence, another of said energization phases which corresponds to said predetermined home position of said movable element, said at least one of said windings being energized for a time span longer than said predetermined energization interval of said energization cycle, for each of said at least one energization phase preceding said another energization phase, said homing control means then causing said motor driver circuit to maintain said another energization phase, and thereby hold said rotor at said predetermined home position.

8. A printer according to claim 7, wherein said time span for which said at least one winding is energized for each of said at least one energization phase is longer than a time duration necessary for substantially settling a rotary oscillating movement of said print wheel during a mechanical blocking of said print wheel by said mechanical blocking means.

9. A printer according to claim 7, further comprising:

a carriage carrying thereon said stepping motor and said print wheel, and movable in a direction parallel to said recording medium supported by said support means; and a wheel holder connected to said rotor of said stepping motor rotatably about an axis thereof, and holding said print wheel, and wherein said mechanical blocking means includes:

a detent arm attached to said carriage pivotally about an axis parallel to said axis of rotation of said wheel holder, said detent arm having a first stop member;

a second stop member provided on said wheel holder, such that said second stop member is engageable with said first stop member during rotation of said wheel holder, for mechanically blocking said wheel holder, and thereby blocking said print wheel from further rotating away from said predetermined home position; and an arm actuator for pivotally moving said detent arm between an operative position in which said first stop member is engageable with said second stop member, and an inoperative position wherein said first stop member is out of a path of said second stop member.

10. A printer according to claim 9 wherein said arm actuator comprises:

biasing means for biasing said detent arm toward said inoperative position; and a stationary actuator member which is engageable with said detent arm, to pivot said detent arm to said operative position against the biasing action of said biasing means, when said carriage is moved to a predetermined position.

11. A printer according to claim 9, wherein said detent arm is provided with a resilient member fixed thereto, said resilient member being elastically deformable to permit said carriage to move to said predetermined position, even if said wheel holder is positioned such that said second stop member abuts on said first stop member during a pivotal movement of said detent arm toward said operative position.

12. A printer according to claim 9, wherein said detent arm is provided with a resilient member fixed thereto, said resilient member being elastically deformable to absorb a positional error between said carriage in said predetermined position and said stationary actuator member.

* * * * *